US007025201B2

(12) United States Patent
Draghetti et al.

(10) Patent No.: US 7,025,201 B2
(45) Date of Patent: Apr. 11, 2006

(54) PACK OF RIGID TYPE FOR TOBACCO PRODUCTS AND A RELATIVE METHOD OF MANUFACTURE

(75) Inventors: Fiorenzo Draghetti, Medicina (IT); Franco Magnoni, Bologna (IT); Mario Spatafora, Bologna (IT)

(73) Assignee: G.D S.p.A., Bologna (IT)

( * ) Notice: Subject to any disclaimer, the term of this patent is extended or adjusted under 35 U.S.C. 154(b) by 140 days.

(21) Appl. No.: 10/492,031

(22) PCT Filed: Oct. 8, 2002

(86) PCT No.: PCT/IB02/04135

§ 371 (c)(1),
(2), (4) Date: Apr. 8, 2004

(87) PCT Pub. No.: WO03/033378

PCT Pub. Date: Apr. 24, 2003

(65) Prior Publication Data

US 2004/0256254 A1 Dec. 23, 2004

(30) Foreign Application Priority Data

Oct. 12, 2001 (IT) ..... BO2001A0629

(51) Int. Cl.
*B65D 85/10* (2006.01)

(52) U.S. Cl. ..... 206/268; 206/273; 493/56

(58) Field of Classification Search ..... 206/242, 206/264, 265, 268, 271, 273; 229/110, 160.1; 493/56, 58

See application file for complete search history.

(56) References Cited

U.S. PATENT DOCUMENTS

| | | | | |
|---|---|---|---|---|
| 4,895,251 | A | 1/1990 | Focke et al. | |
| 5,044,550 | A * | 9/1991 | Lamm | 229/160.1 |
| 5,097,948 | A * | 3/1992 | Campbell | 206/268 |
| 5,323,957 | A * | 6/1994 | Roosa | 229/110 |
| 6,726,006 | B1 * | 4/2004 | Funderburk et al. | 206/268 |
| 6,755,300 | B1 * | 6/2004 | Brizzi | 206/273 |

FOREIGN PATENT DOCUMENTS

| | | |
|---|---|---|
| DE | 583756 | 9/1933 |
| EP | 0764595 | 3/1997 |
| EP | 0930245 | 7/1999 |
| WO | 99/65796 | 12/1999 |
| WO | 02/48006 | 6/2002 |

OTHER PUBLICATIONS

European Search Report dated Jan. 22, 2003.

* cited by examiner

*Primary Examiner*—Luan K. Bui
(74) *Attorney, Agent, or Firm*—Harbin King & Klima

(57) ABSTRACT

A rigid pack of substantially parallelepiped appearance for tobacco products appears as a container (5) with an open top end (6), surmounted by a lid (7) hinged to the container (5) and rotatable between positions in which the top end (6) is open and closed. The pack (1) presents four lateral faces (17, 18, 19), and two end faces (12, 16) disposed mutually parallel and perpendicular to the lateral faces (17, 18, 19); at least one of the six faces (12, 16, 17, 18, 19) presents a raised portion (22) with an outwardly directed convex profile obtained by plastically deforming at least one panel (43, 44) of a blank (31) before the blank is folded around the tobacco products to fashion the pack (1).

27 Claims, 8 Drawing Sheets

PACK OF RIGID TYPE FOR TOBACCO PRODUCTS AND A RELATIVE METHOD OF MANUFACTURE

This application is the National Phase of International Application PCT/IB02/04135filed Oct. 8, 2002 which designated the U.S. and that International Application was published under PCT Article 21(2) in English.

TECHNICAL FIELD

The present invention relates to a pack of rigid type for tobacco products.

The term "pack" used throughout the following specification can be taken to mean either a packet of cigarettes, or a carton containing a plurality of packets of cigarettes.

BACKGROUND ART

Generally, where packets of cigarettes are concerned, cigarettes emerging from a cigarette maker are ordered into groups each making up the contents of one packet. The single group is enveloped first in a sheet of metal foil paper constituting an inner wrapper, in such a manner as to create a block of substantially parallelipiped geometry.

Each block is then enveloped by a diecut blank, bent along previously formed crease lines and folded thus around the block to fashion an outer wrapper appearing as a rigid packet with a hinged lid that presents the shape of a rectangular parallelepiped with a front face, a rear face and two end faces, top and bottom.

Such rigid packets are normally of the type comprising a body of cupped appearance surmounted by a lid likewise of cupped appearance, which is hinged to a top edge of the body and rotatable thus between an open position, and a position in which the cupped body is closed.

The cigarettes internally of each packet are ordered side by side in rows, typically in three rows each comprising a number of cigarettes that will vary according to the size of the selfsame cigarettes and of the packet.

Packets of the type in question betray certain drawbacks, the most noticeable of which stems from the particular shape of the packet and from the method of manufacture outlined above. In effect, the blocks of cigarettes are bound tightly by the outer wrapper along their full length, with the result that the single cigarettes are difficult to extract when the packet is opened. This drawback relates in particular to the cigarettes of the row in tight contact with the front inside surface of the packet, as these are the first to be removed by the smoker.

Another drawback liable to affect these packets is attributable to the fact that the method of assembly can also occasion a damaging axial compression of the cigarettes between the two end faces.

In the case of cartons, single packets turned out by a packer are ordered into groups of substantially parallelepiped shape, whereupon each group is taken up by a cartoner and enveloped in a diecut blank bent along previously formed crease lines in such a way as to obtain a wrapper consisting in a rigid carton, for example of the type with a hinged lid, presenting the shape of a rectangular parallelepiped with a front face, a rear face and two end faces, top and bottom.

Likewise in this instance, cartons produced by the machines currently in use are compacted in the extreme, with the blank wrapped tightly around the respective group of packets, so that the first few packets are difficult to extract when the carton is opened.

The object of the present invention is to provide a pack of rigid type for tobacco products, embodied in such a way as to overcome the drawbacks described above.

DISCLOSURE OF THE INVENTION

The stated object is realized according to the present invention in a pack of rigid type for tobacco products, presenting lateral faces and end faces and comprising a wrapper composed of a container with an open top end, and a lid by which the open top end is closed, characterized in that at least one face of the pack presents at least one raised portion with an outwardly directed convex profile.

The present invention relates also to a method of manufacturing packs of rigid type for tobacco products.

The stated object is realized according to the invention in a method by which to manufacture packs of rigid type for tobacco products, departing from a flat diecut blank presenting a plurality of longitudinal crease lines and a plurality of transverse crease lines combining with the longitudinal crease lines to define a plurality of panels coinciding singly or in overlapping association with the faces of the pack, characterized in that it comprises the steps of advancing the blanks along a predetermined conveying line through a forming station, and deforming at least one of the panels plastically at the forming station in such a way as to generate a raised portion.

The invention will now be described in detail, by way of example, with the aid of the accompanying drawings, in which.

Figure 9:
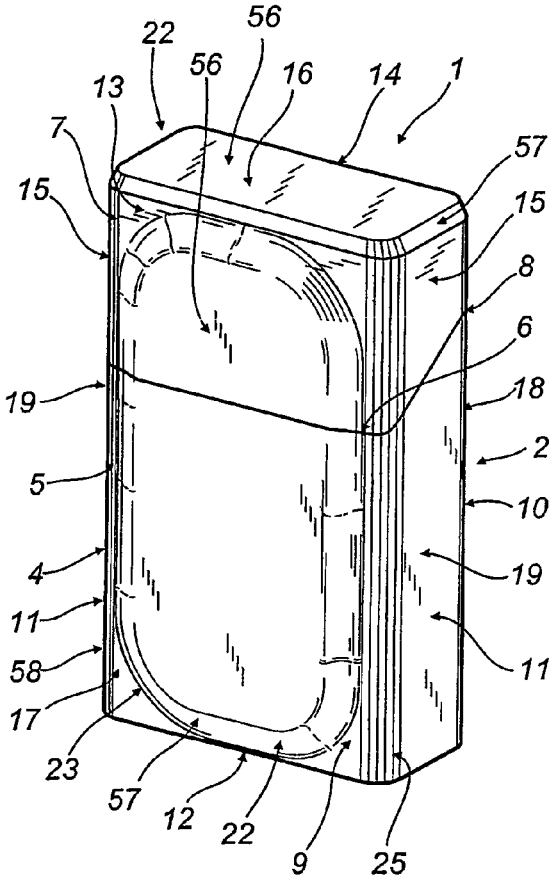
Figure 10:
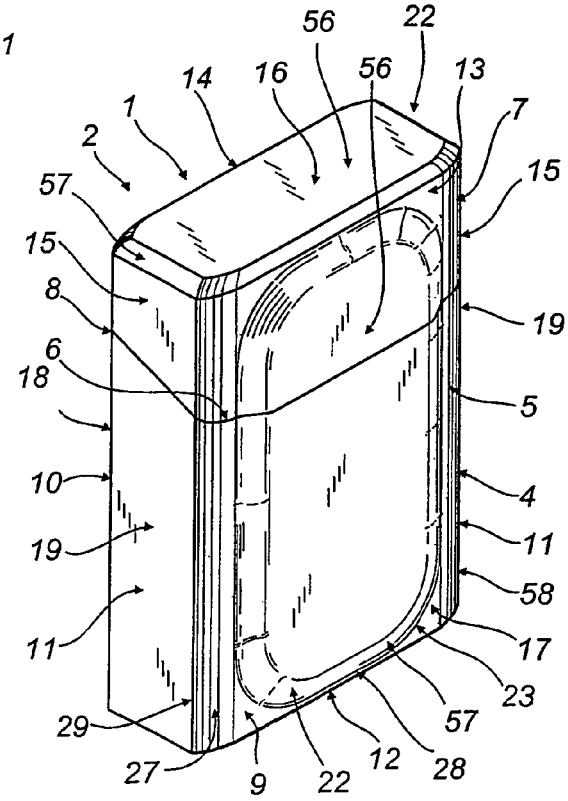
Figure 11:
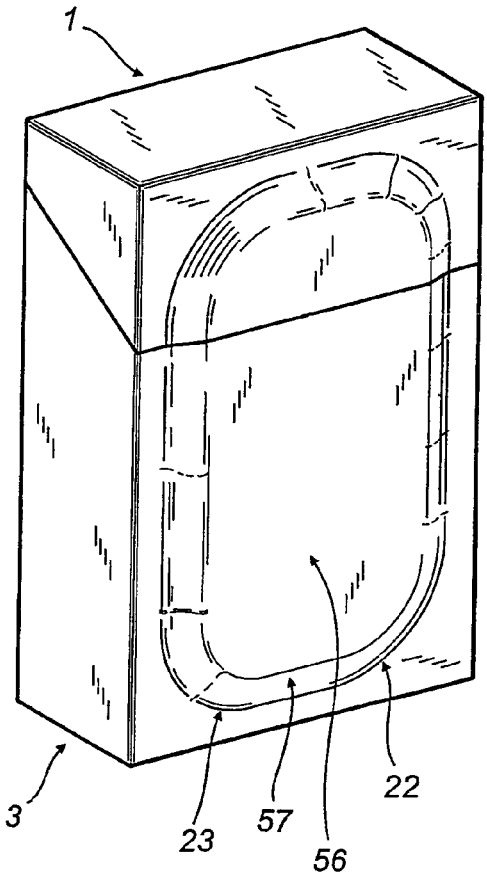
FIGS. 11 and 12 illustrate an embodiment of a pack embodied in accordance with the present invention, in particular a carton containing a plurality of packets of cigarettes, viewed schematically and in perspective in two configurations, closed and open respectively.
Figure 12:
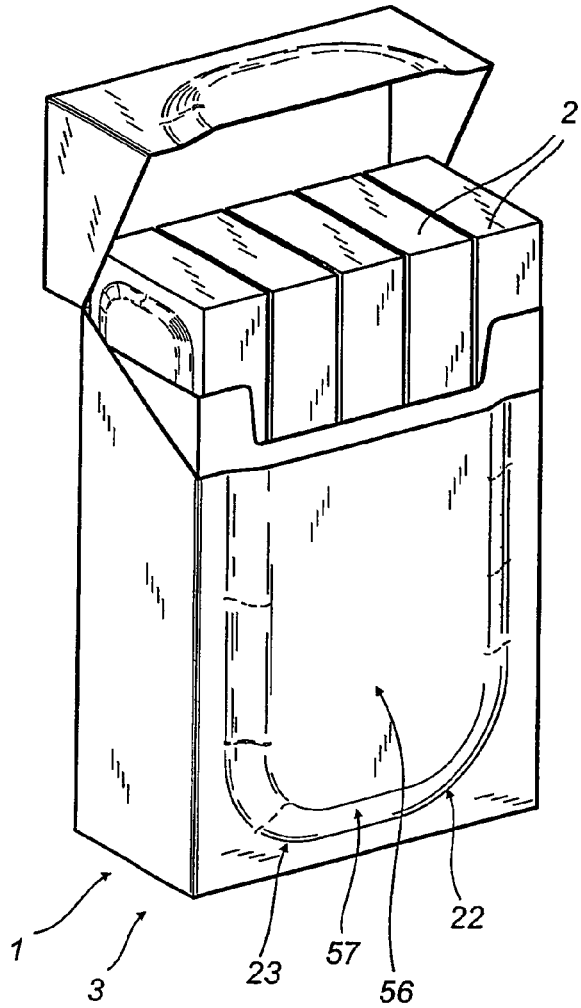

With reference to FIGS. 1 to 12 of the drawings, 1 denotes a rigid pack for tobacco products, in its entirety, which in the example of FIGS. 1 to 10 consists in a rigid packet 2 serving to contain a group of cigarettes (not illustrated), whereas in FIGS. 11 and 12 the pack consists in a carton 3 containing a plurality of packets 2. The pack 1 appears substantially parallelepiped in shape with longitudinal corner edges denoted 58, and comprises an outer wrapper 4 in its turn comprising a cupped container 5 with an open top end 6; the container is surmounted by a lid 7 also of cupped embodiment, hinged to the container 5 along a crease line 8 and rotatable thus between a position in which the top end 6 is exposed (illustrated in FIGS. 6 and 8) and a position in which the selfsame top end 6 is concealed.

The container 5 presents a front 9, a back 10, two flanks 11, and a bottom 12; the lid 7 similarly presents a front 13, a back 14, two flanks 15, and a top 16.

The front, back and flanks of the container 5 and of the lid 7 combine respectively to form four lateral faces of the single pack 1, of which the front face is denoted 17, the rear face is denoted 18 and the flank faces are denoted 19, these same four faces combining with the bottom 12 of the container 5 and the top 16 of the lid 7 to establish the outer wrapper 4 of the pack 1.

Figure 6:
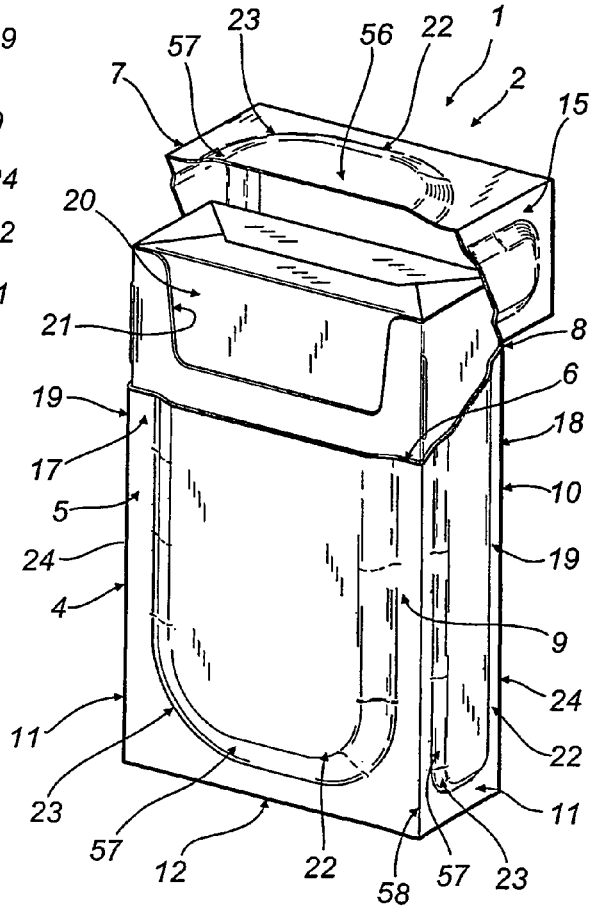
Figure 7:
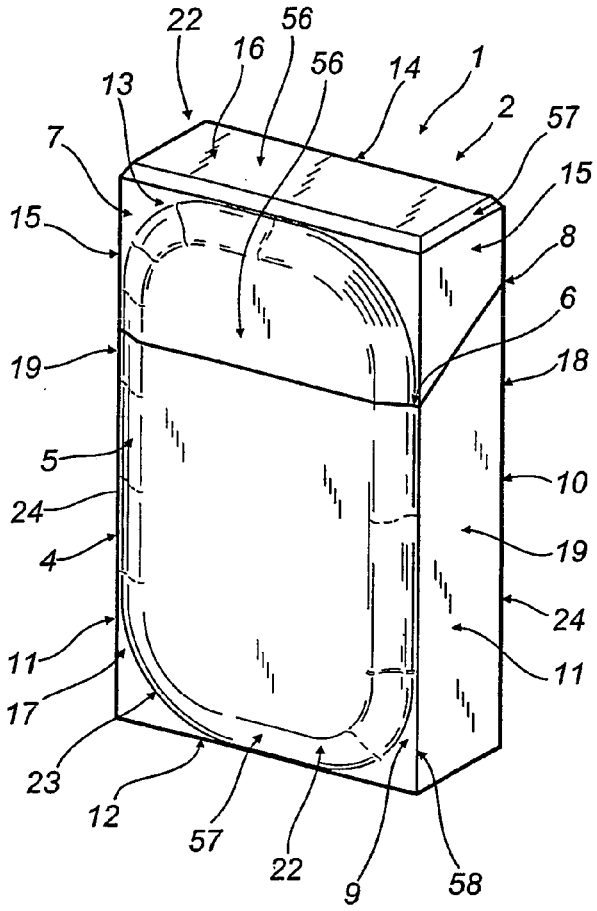
Figure 8:
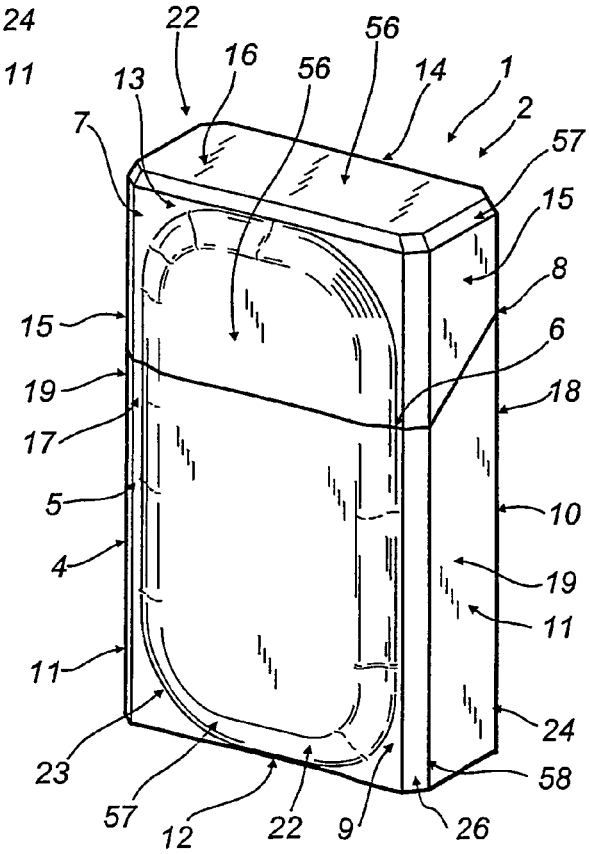

As illustrated particularly in FIG. 6, the single packet 2 accommodates an inner wrapper 20 enveloping the aforementioned group of cigarettes and is furnished with a reinforcing frame 21 interposed between the outer wrapper 4 and the inner wrapper 20, anchored to the container 5 and projecting in part from the open top end 6 of the selfsame container 5 to provide a stabilizing element for the lid 7 when in the closed position.

In the examples of FIGS. 1 to 6, and 11 and 12, at least one of the six faces 12, 16, 17, 18 and 19 (both flank faces being denoted 19) of the pack 1 presents a raised portion 22 with an outwardly directed convex profile.

The raised portion 22 is circumscribed by an outline 23 and occupies a substantially central area of at least one face 12, 16, 17, 18 and 19 presented by the pack 1, excluding the parts adjacent to the edges of the face 12, 16, 17, 18 and 19.

In other embodiments not illustrated in the drawings but readily conceivable by a person skilled in the art, the raised portion 22 could extend at least in part to meet the edge of the occupied face. Moreover,the raised portion 22 could be fashioned in such a way as to present a substantially flat central portion 56 and a surrounding fillet 57 by which the central portion 56 and the corresponding face of the pack 1 are interconnected.

It will be seen that the raised portions, when located in particular on the front and rear faces 17 and 18 of the pack 1, have the effect of relieving the pressure exerted by the outer wrapper 4 on the inner wrapper 20, making it easier to draw out the cigarettes when the packet 2 is opened. It will be seen in any event that the consequent reduction in tightness does not affect the stable positioning of the cigarettes inside the packet 2, since the outer wrapper 4 remains in close contact with the inner wrapper 20 at the longitudinal ends of the selfsame wrapper 20 lying outside the compass of the raised portion 22.

Figure 5:
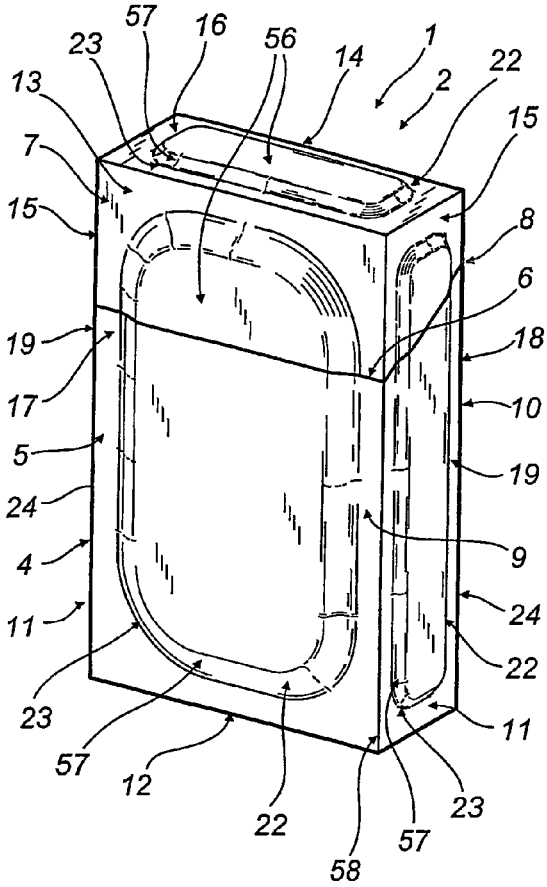

In the examples of FIGS. 5 and 6, the raised portions 22 appear not only on the front and rear faces 17 and 18 but also on the two flank faces 19, the bottom end face 12 and the top end face 16. In this instance the packet 2 is more easily handled, and in particular, the effect of generating raised portions 22 on the bottom and top end faces 12 and 16 is to cushion the ends of the cigarettes.

In the examples of FIGS. 11 and 12, the raised portion 22 is located on the front face 17 of the carton 3, and in consequence the packets 2 are more easily extracted from the carton 3, for the same reasons as indicated previously in referring to the cigarettes of the single packet 3.

Figure 1:
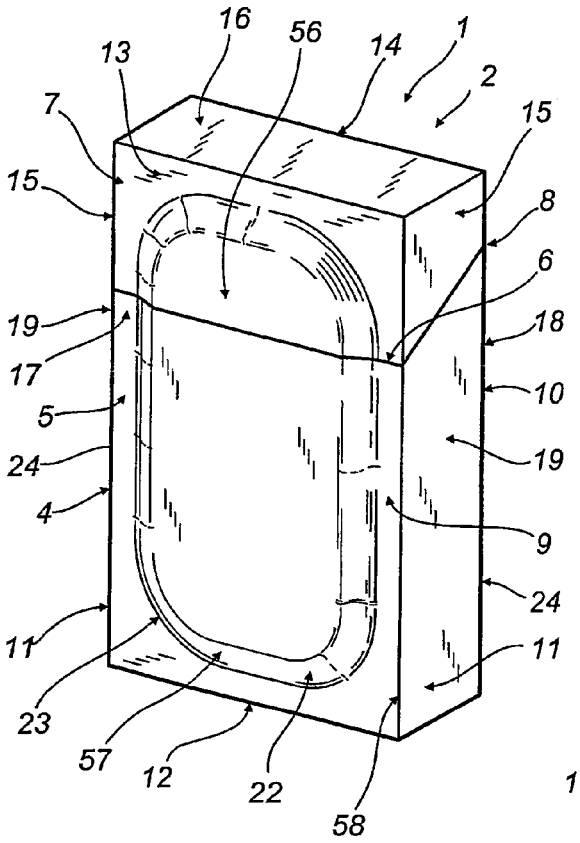
FIGS. 1 to 10 illustrate several embodiments of a pack embodied in accordance with the present invention, in particular a packet of cigarettes, viewed schematically and in perspective.
Figure 2:
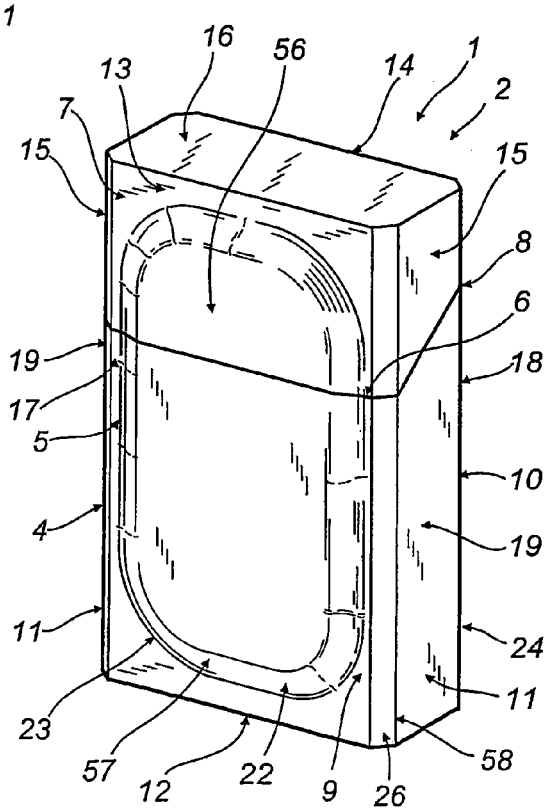
Figure 3:
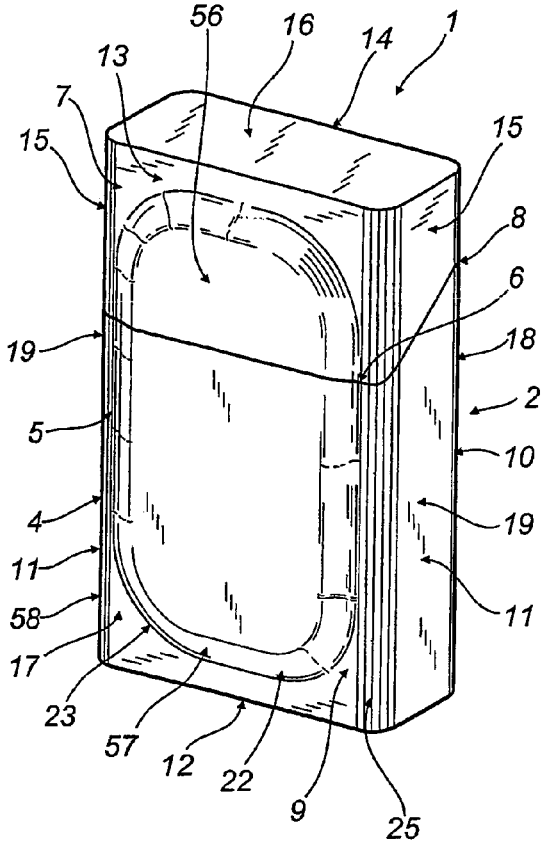
Figure 4:
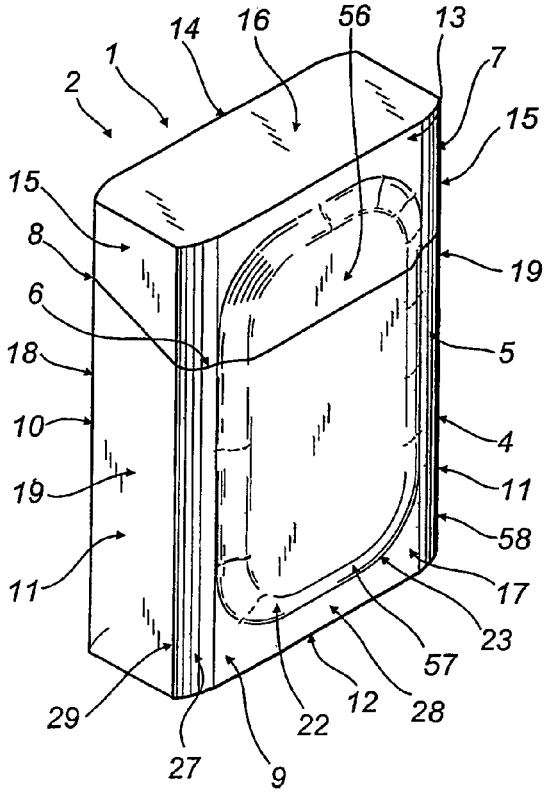

As illustrated in FIGS. 1 to 4, the longitudinal corner edges 58 of the packets 2 might appear as sharp corner edges 24 (FIG. 1), or rounded corner edges 25 (FIG. 3), or bevelled corner edges 26 (FIG. 2), or alternatively, as in the example of FIG. 4, with a band 27 of curved section extending along each of the corner edges 58 and disposed with the concave face directed inwards, by which a central part 28 of the relative front face 17 or rear face 18 is joined to the adjacent flank face 19 along a sharp corner edge 29.

Further embodiments of the pack 1 are illustrated in FIGS. 7 to 10. More exactly, FIGS. 7 and 8 each show a top end face 16 presenting a raised portion 22 that consists in a substantially flat central portion 56 joined to the peripheral edges of the selfsame face 16 by way of a fillet 57 consisting in rectilinear segments connected one to the next by way of sharp corners. In FIG. 9 the top end face 16 presents a raised portion 22 consisting in a substantially flat central portion 56 joined to the peripheral edges of the selfsame face 16 by way of a fillet 57 consisting in rectilinear segments interconnected by curved segments. In FIG. 10, finally, the top end face 16 presents a raised portion 22 consisting in a substantially flat central portion 56 joined to the peripheral edges of the selfsame face 16 by way of a fillet 57 consisting in rectilinear segments interconnected by way of curved segments and sharp corners.

The embodiments illustrated in FIGS. 2, 3 and 4 and FIGS. 7 to 10 are similarly applicable in the case of a carton 3.

Figure 13:
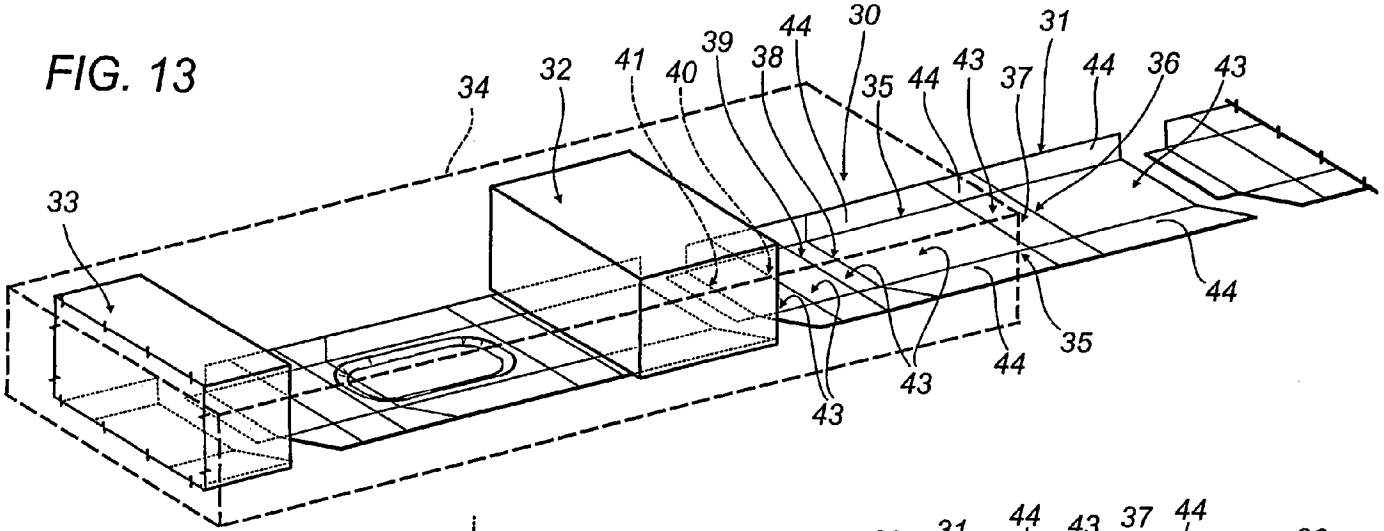
FIG. 13 illustrates a line for the manufacture of packs embodied in accordance with the present invention, viewed schematically in perspective and represented by blocks, equipped with a forming device according to the invention.

FIG. 13 illustrates a conveying line 30, and advancing along the line, a succession of flat diecut cardboard blanks 31 from which the packs 1 are fashioned.

The line 30 passes through a forming station indicated in FIG. 13 by a block denoted 32, and extends thereafter toward a wrapping unit 33. The forming station 32 may or may not constitute an integral part of a packaging machine, indicated in the interests of simplicity by a block 34 drawn in phantom lines.

As discernible in FIGS. 13 to 16, the single flat diecut blank 31 is of essentially rectangular outline and presents two longitudinal crease lines 35, also a plurality of transverse crease lines 36 . . . 41 that combine with the two longitudinal crease lines 35 to define a plurality of panels 43 and 44 coinciding either singly, in the case of the panels denoted 43, or in overlapping association, as in the case of the panels denoted 44, with the six faces 12, 16, 17, 18 and 19 of the pack 1.

On arrival at the forming station 32, at least one of the panels 43 and/or 44 presented by each blank 31 is deformed plastically in such a way as to generate the raised portion 22.

Figure 14:
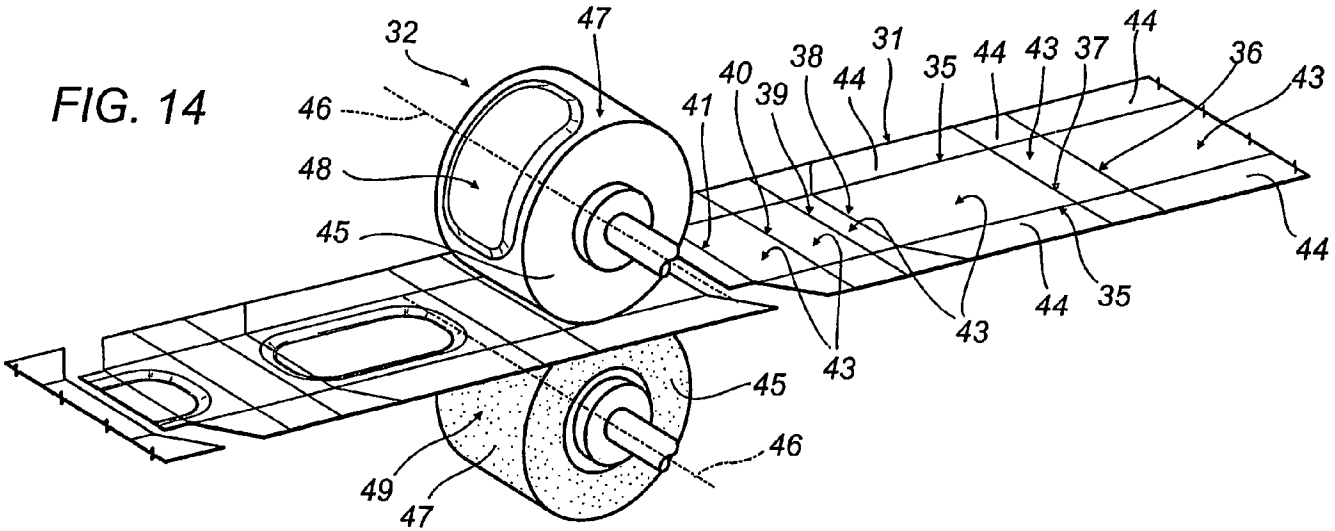
Figure 15:
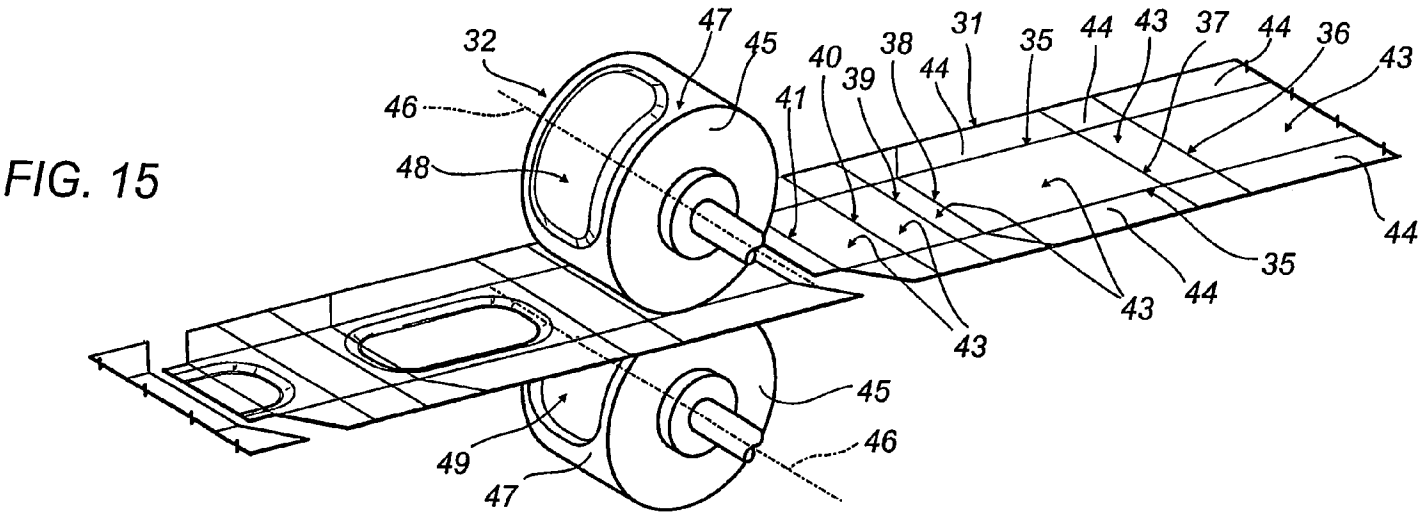

Observing FIGS. 14 and 15, it will be seen that the blanks 31 are advanced continuously along the line 30 and the plastic deformation is brought about by a pair of rollers 45 contrarotating about axes 46 transverse to the line 30 and operating in concert. The rollers 45 are located on opposite sides of the line 30 and at least one, the top roller as viewed in FIGS. 10 and 11, presents a cylindrical surface 47 with at least one projection 48 functioning as a die such as will produce the raised portion 22 on the respective panel 43 and/or 44 of the blank 31.

In the example of FIG. 14 the cylindrical reaction surface 47 of the second roller 45, the bottom roller as viewed in FIGS. 14 and 15, is embodied in a resilient material so as to yield on contact with the projection 48 of the top roller 45 and thus allow the raised portion 22 to be impressed on the blank 31.

In the example of FIG. 15, the cylindrical surface 47 of the second or bottom roller 45 affords at least one recess 49 functioning as a bottom die matched to the projection 48 of the top roller 45 and allowing the raised portion 22 to be impressed on each blank 31.

Figure 16:
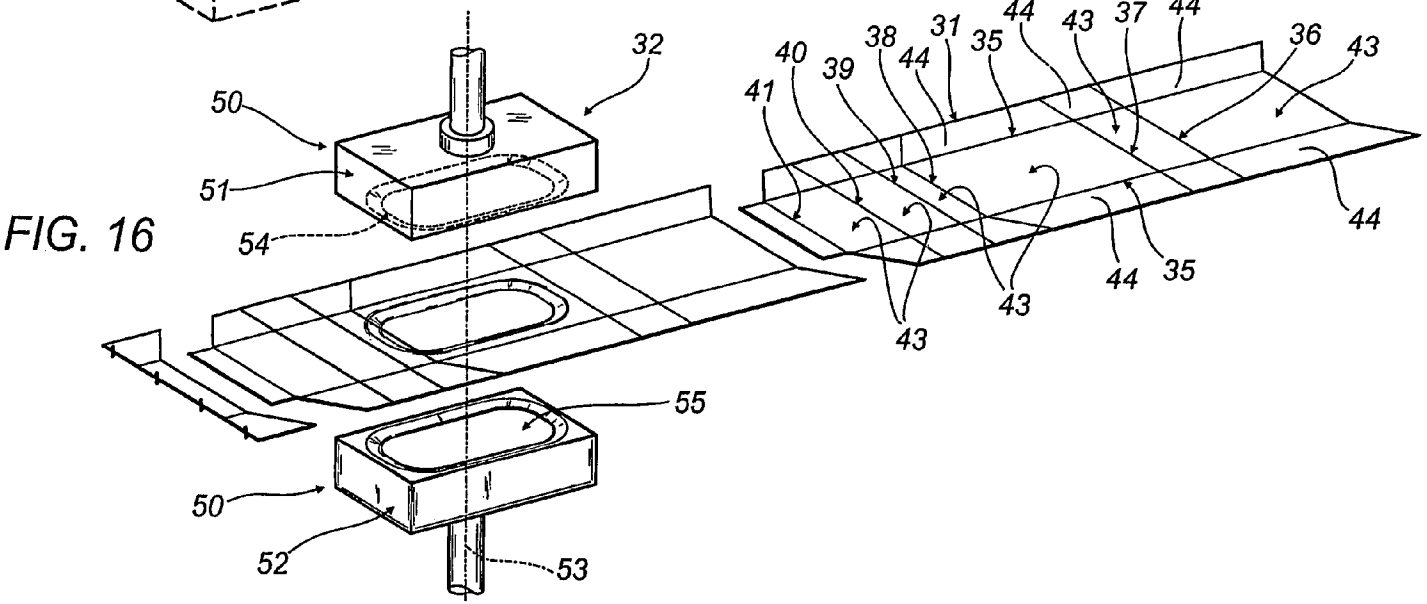
FIGS. 14, 15 and 16 illustrate three different embodiments of the forming device shown in FIG. 9, viewed schematically in perspective and with certain parts omitted.

In the example of FIG. 16, the single blanks 31 are brought momentarily to a standstill at the forming station 32 and in this instance deformed plastically by a pair of tools 50 consisting in a punch 51 and a counter 52 operating in concert and invested with reciprocating motion in a direction 53 transverse to the conveying line 30. The tools 50 are located on opposite sides of the line 30 and at least one, the punch 51 in the example of FIG. 16, presents a projection 54 functioning as a die designed to interact with a recess 55 afforded by the counter 52 in producing the raised portion 22 on each blank 31.

In a further embodiment not illustrated in the drawings, the second tool 50, that is to say the counter 52, can be fashioned from a resilient material such as will yield on contact with the projection 54 of the punch 51 and thus allow the raised portion 22 to be impressed on each blank 31.

In the example of 6, the frame 21 presents a breast piece fixed to the front 9 of the container 5 and two side pieces fixed to the corresponding flanks 11 of the container 5. In an alternative embodiment of the pack 1 of FIG. 6, not illustrated in the drawings, the frame 21 presents at least one raised portion with a convex profile projecting outward from the pack 1. The raised portion in question will be completely and closely matched to the inside surface of a respective raised portion 22 presented by the front face 17 or flank face 19 of the pack 1.

In particular, the breast and/or side pieces of the frame 21 will present raised portions identical to and matching the aforementioned raised portions 22 of the blank 31. Accordingly, when the packet 2 is closed, the breast piece of the frame 21 registers in full frontal contact with the inside surfaces of the packet fronts 9 and 13, and/or the side pieces of the frame 21 register in full frontal contact with the inside surfaces of the packet flanks 11 and 15.

An alternative solution similar to that just described might naturally be adopted for the pack 1 of FIG. 12.

What is claimed is:

1. A pack of rigid type for tobacco products, presenting lateral faces (17, 18, 19) and end faces (12, 16) and comprising a wrapper (4) composed of a container (5) with an open top end (6), and a lid (7) by which the open top end is closed, characterized in that at least one face (12, 16, 17, 18, 19) of the pack (1) presents at least one raised portion (22) with an outwardly directed convex profile, the raised portion (22) occupying an area of the respective face (12, 16, 17, 18, 19) coinciding both with the container (5) and with the lid (7).

2. A pack as in claim 1, wherein the raised portion (22) occupies a substantially central area of the respective face (12, 16, 17, 18, 19), excluding the parts adjacent to the edges of the selfsame face.

3. A pack as in claim 1, wherein the raised portion (22) occupies a substantially central area of the respective face (12, 16, 17, 18, 19) and extends at least in part to meet the edge of the selfsame face.

4. A pack as in claim 1, wherein the raised portion (22) is presented by the lateral faces (17, 18).

5. A pack as in claim 1, wherein the raised portion (22) is presented by each one of the faces (12, 16, 17, 18, 19).

6. A pack as in claim 1, wherein the raised portion (22) presents a substantially flat central portion (56).

7. A pack as in claim 1, wherein the raised portion (22) presents a surrounding fillet (57) by way of which the central portion (56) is joined to the corresponding face (12, 16, 17, 18, 19) of the pack (1).

8. A pack as in claim 7, wherein the fillet (57) comprises rectilinear segments interconnected by curved segments.

9. A pack as in claim 8, wherein the fillet (57) comprises rectilinear segments connected one to the next by sharp corners.

10. A pack as in claim 1, wherein the wrapper (4) presents bevelled longitudinal corner edges (26).

11. A pack as in claim 1, wherein the wrapper (4) presents rounded longitudinal corner edges (25).

12. A pack as in claim 1, wherein the wrapper (4) presents a band (27) of curved section extending along each of the longitudinal corner edges and disposed with the concave face directed inwards, by which a relative central part (28) of one lateral face (17, 18, 19) is joined to an adjacent lateral face (17, 18, 19) along a sharp corner edge (29).

13. A pack as in claim 1, presenting a substantially parallelepiped appearance with a lid (7) hinged to the container (5) and rotatable thus between positions in which the top end (6) is open and closed, wherein the wrapper (4) presents four longitudinal corner edges (58) defining four lateral faces (17, 18, 19) disposed in mutually parallel pairs, and two end faces (12, 16) disposed mutually parallel and perpendicular to the lateral faces (17, 18, 19).

14. A pack as in claim 13, comprising a frame (21) fixed to the container (5), projecting in part from the open top end (6) so as to interact with and stabilize the lid (7) when occupying the closed position, and presenting at least one raised portion with a convex profile projecting outward from the pack (1).

15. A pack as in claim 14, wherein the raised portion of the frame (21) is positioned in full frontal contact with an inside surface of a raised portion (22) presented by a lateral face (17, 19) of the pack (1).

16. A pack as in claim 1, wherein the tobacco products consist in a plurality of packets of cigarettes (2), and the pack (1) is a carton (3).

17. A pack as in claim 1, wherein the tobacco products consist in a group of cigarettes, and the pack (1) is a cigarette packet (2).

18. A method of manufacturing packs of rigid type as in claim 1 obtainable departing from a flat diecut blank (31) presenting a plurality of longitudinal crease lines (35) and a plurality of transverse crease lines (36 . . .41) combining with the longitudinal crease lines (35) to define a plurality of panels (43, 44) coinciding singly or in overlapping association with the faces (12, 16, 17, 18, 19) of the pack (1), characterized in that it comprises the steps of advancing the blanks (31) along a predetermined conveying line (30) through a forming station (32), and deforming at least one of the panels (43, 44) plastically at the forming station (32) in such a way as to generate a raised portion (22).

19. A method as in claim 18, wherein the step of advancing the blanks (31) through the forming station (32) is a continuous operation.

20. A method as in claim 18, wherein the step of advancing the blanks (31) through the forming station (32) includes a pause at the selfsame station (32).

21. A method as in claim 19, wherein the plastic deformation step is implemented through the agency of a pair of rollers (45) operating in concert, contrarotating about axes (46) transverse to the conveying line (30) and located on opposite sides of the selfsame line (30), including at least a first roller (45) of which the cylindrical surface (47) presents at least one projection (48) functioning as a die such as will produce the raised portion (22).

22. A method as in claim 21, wherein the second roller (45) of the pair is embodied in resilient material.

23. A method as in claim 21, wherein the second roller (45) of the pair presents a cylindrical surface (47) affording at least one recess (49) functioning as a bottom die matched to the die of the first roller.

24. A method as in claim 20, wherein the plastic deformation step is implemented through the agency of a pair of tools (50) consisting in a punch (51) and a counter (52) operating in concert, invested with reciprocating motion relative to the conveying line (30) and located on opposite sides of the selfsame line (30), including at least a first tool (50) furnished with a projection (54) functioning as a die such as will produce the raised portion (22).

25. A method as in claim 22, wherein the second tool (52) of the pair (50) is embodied in resilient material.

26. A method as in claim 24, wherein the second tool (52) of the pair (50) presents a surface offered to the opposite tool (51) furnished with at least one recess (55) functioning as a bottom die matched to the die of the first tool.

27. A method as in claim 19, wherein the conveying line (30) carrying the blanks (31) and the forming station (32) are an integral part of a machine (34) by which the packs (1) are manufactured.

* * * * *